US005400630A

United States Patent [19]

Okumura et al.

[11] Patent Number: 5,400,630

[45] Date of Patent: Mar. 28, 1995

[54] METHOD FOR PRODUCING REGENERATED CYLINDER, METHOD FOR PRODUCING REGENERATED ELECTROPHOTOGRAPHY PHOTOSENSITIVE DRUM EMPLOYING THE METHOD, AND BULGING APPARATUS FOR THE METHODS

[75] Inventors: Toru Okumura, Yokohama; Eiichi Kato, Tsukuba; Yasuyoshi Takai, Nagahama, all of Japan

[73] Assignee: Canon Kabushiki Kaisha, Tokyo, Japan

[21] Appl. No.: 77,642

[22] Filed: Jun. 17, 1993

[30] Foreign Application Priority Data

Jun. 24, 1992 [JP] Japan ..... 4-188955
Jun. 24, 1992 [JP] Japan ..... 4-188966
Jul. 3, 1992 [JP] Japan ..... 4-200367

[51] Int. Cl.[6] ..... B21D 26/02

[52] U.S. Cl. ..... 72/55; 72/60; 29/421.1; 29/895.1; 29/895.3

[58] Field of Search ..... 29/421.1, 446, 895.1, 29/895.3, 402.19, 557; 72/60, 62, 55

[56] References Cited

U.S. PATENT DOCUMENTS 647,334 4/1990 Shuman ..... 29/895.3

FOREIGN PATENT DOCUMENTS 0016092 6/1912 Germany ..... 29/895.1
0004325 1/1981 Japan ..... 29/421.1
0132325 8/1983 Japan ..... 29/421.1
0215228 12/1983 Japan ..... 29/421.1
63-49548 4/1988 Japan .
2178671 7/1990 Japan .

*Primary Examiner*—David Jones
*Attorney, Agent, or Firm*—Fitzpatrick, Cella, Harper & Scinto

[57] ABSTRACT

Flanges used in a photosensitive drum to be regenerated are assembled in a regenerated electrophotography photosensitive drum employing a regenerated cylinder having a diameter enlarged by regeneration processes.

The regenerated electrophotography photosensitive drum is obtained by enlarging the diameter of the photosensitive drum to be regenerated whose photosensitive film has not functioned normally because of being used up or damaged during preparation or the like, cutting off the surface, including the photosensitive film, of the cylinder with predetermined precision with respect to the outer diameter and the surface, and forming a photosensitive film on the resultant regenerated cylinder. A flange with a bearing used in the photosensitive drum to be regenerated is assembled in the flange attachment position of the regenerated electrophotography photosensitive drum with a spacer placed for adjusting the inner diameter increment and axial contruction due to the diameter enlargement, thereby obtaining the regenerated electrophotography photosensitive drum unit.

8 Claims, 9 Drawing Sheets

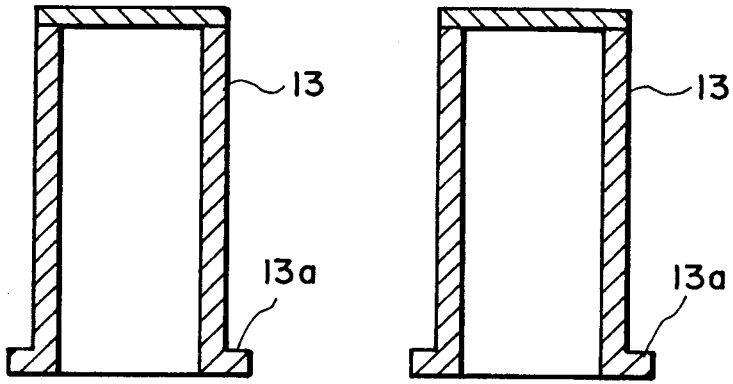
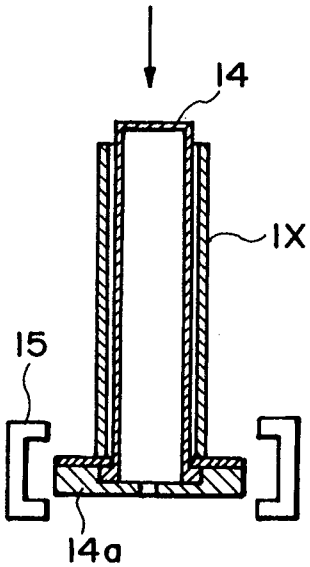
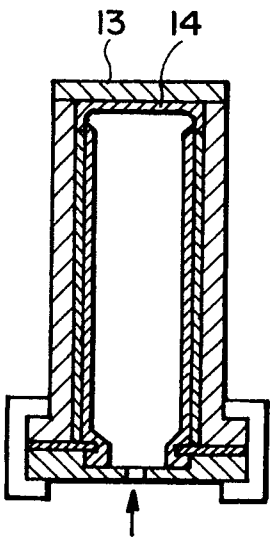
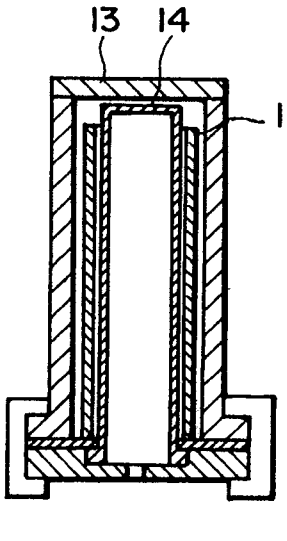
FIG. 3A
FIG. 3B
FIG. 3C
FIG. 3D

METHOD FOR PRODUCING REGENERATED CYLINDER, METHOD FOR PRODUCING REGENERATED ELECTROPHOTOGRAPHY PHOTOSENSITIVE DRUM EMPLOYING THE METHOD, AND BULGING APPARATUS FOR THE METHODS

BACKGROUND OF THE INVENTION

1. Field of the Invention

The present invention relates to a method for regenerating a cylinder of an electrophotography photosensitive drum used in an image forming apparatus of electrophotography type, a method for producing the photosensitive drum employing the method, and a bulging apparatus for executing the methods.

2. Related Background Art

Generally, an image forming apparatus of electrophotography type such as a laser beam printer, a facsimile apparatus, a printer, and the like is, as shown in FIG. 13, provided with a cleaning blade 104, a charged roller 105, a developing roller 106 and a transfer roller 107, which are positioned with high precision in the order named around the circumference of an electrophotography photosensitive drum (hereinafter referred as "photosensitive drum") 101 consisting of a cylinder 102 and a photosensitive film 103 covering the peripheral surface thereof. For example, precision of arrangement of the photosensitive drum 101 and the developing roller 106 is such that the developing roller 106 is fixed so as to have a uniform clearance of 0.2 to 0.4 millimeter from the photosensitive drum 101, wherein precision of uniformity of said clearance is required to be in the order of a tenth part of the width (distance) of the clearance. Therefore, the cylinder 102 used as the photosensitive drum 101 is required to have high mechanical precision. In addition, impurities contained in the materials which constitute the cylinder 102 must be strictly controlled in order to form an excellent photosensitive film 103.

Therefore, the cylinder 102 should be very expensive, and regeneration thereof is desirable.

Accordingly, the following regeneration methods have been proposed.

(a) A method in which the photosensitive film of a used cylinder is removed by etching, and then a photosensitive film is formed again so as to prepare a photosensitive drum having the same outer diameter as before (see Japanese Laid-Open Patent Application No. 2-178671).

(b) A method in which a cylinder has a double structure consisting of an outer cylinder and an inner cylinder, which are separable from each other, so that only the outer cylinder coated with a photosensitive film is replaced by a new one (see Japanese Laid-Open Utility Model Application No. 63-49548).

On the above-mentioned conventional techniques, the method (a) performs a heating process in vacuum in the etching step of removing the photosensitive film. So, machining time is long and productivity is low. In addition, since chemicals are used, waste liquid treatment is necessary.

On the other hand, the method (b) has to maintain mechanical precision such as circularity of the outer cylinder, and so on. Therefore the thickness of the outer cylinder cannot be thinner than a certain limit, wherein the portion to be disposed is large and cost merit is small.

SUMMARY OF THE INVENTION

The above-mentioned drawbacks in prior art being considered, the present invention was made, whose object is to realize: a method for producing an inexpensive regenerated cylinder having excellent productivity from an electrophotography photosensitive drum (hereinafter referred as "photosensitive drum to be regenerated") whose photosensitive film has not functioned normally because of being used up or damaged during preparation or the like; a method for preparing the regenerated electrophotography photosensitive drum employing said method; and a bulging apparatus for executing said methods.

In order to achieve the above-mentioned object, the method according to the present invention for producing the regenerated cylinder comprises steps of an enlarging the diameter of the electrophotography photosensitive drum to be treated, wherein a photosensitive film of the drum coated over the cylinder surface has not functioned normally, by means of a bulging apparatus so as to obtain the electrophotography photosensitive drum whose diameter is enlarged to predetermined size, and cutting off the cylinder surface including the photosensitive film of the electrophotography photosensitive drum after the diameter enlargement with predetermined precision so as to obtain the regenerated cylinder.

The bulging apparatus used for executing the methods of the present invention enlarges the outer diameter of an electrophotography photosensitive drum to be regenerated, whose photosensitive film coated over the cylinder surface has not functioned normally, to predetermined size. The apparatus comprises a gum mold shift unit inserted into said electrophotography photosensitive drum to be regenerated, and provided with two gum mold support units which can be lifted up/down and support hollow gum molds, wherein pressurized fluid is supplied inside the hollow gum molds, guide means for horizontally reciprocating said gum mold shift unit so that one gum mold support unit is positioned at a diameter enlargement stage when the other gum mold support unit is positioned at a delivery stage, and a metal mold revolving unit having a revolvable hand and metal molds which have cylindrical cavities of a predetermined inner diameter and are provided radially at the same distance from a pivot of said revolvable hand, wherein each of the gum mold support units is provided with a clamp unit for uniting said gum mold and said metal mold, and the metal mold revolving unit is arranged so as to position the metal mold provided in said revolvable hand with respect to the gum mold of the gum mold support unit positioned at the diameter enlargement stage.

Another object of the present invention is to realize a regenerated electrophotography photosensitive drum unit, wherein peripheral components previously assembled in the photosensitive drum to be regenerated are assembled in the electrophotography photosensitive drum regenerated by employing the regenerated cylinder whose diameter has been enlarged by the above-mentioned regeneration processes.

In order to achieve the above object, the electrophotography photosensitive drum employing the regenerated cylinder of the present invention is characterized in that a photosensitive film is formed on the surface of the regenerated cylinder whose diameter has been enlarged by the regeneration processes, and that flanges to be assembled to the regenerated photosensitive drum are assembled to flange attachment positions of the regenerated electrophotography photosensitive drum with spacers therebetween for adjusting the inner diameter increment and contraction in the axial direction due to said diameter enlargement.

Furthermore, in order to achieve the above-mentioned object, the regenerated electrophotography photosensitive drum employing the regenerated cylinder of the present invention which has a photosensitive film formed on the curved surface of the regenerated cylinder whose diameter has been enlarged by the regeneration processes is characterized in that at least one end portion of said regenerated electrophotography photosensitive drum is subjected to additional working to newly form an attachment position having shape and size of other kinds of electrophotography photosensitive drums.

BRIEF DESCRIPTION OF THE DRAWINGS

FIGS. 3A to 3D are explanatory views showing each step of bulging according to the method of the present invention.

DESCRIPTION OF THE PREFERRED EMBODIMENTS

Preferred embodiments of the present invention will be described according to the drawings.

Figure 1:
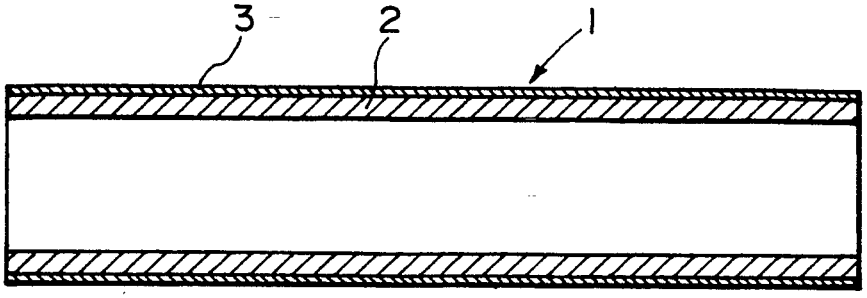
FIG. 1 is a schematic cross-sectional view of a regenerated electrophotography photosensitive drum according to the method of the present invention.

FIG. 1 is a cross-sectional view of a regenerated electrophotography photosensitive drum produced by the method of the present invention.

The regenerated electrophotography photosensitive drum 1 is obtained by enlarging the diameter of the photosensitive drum to be regenerated according to a method described later, cutting off the curved surface thereof with predetermined precision with respect to the outer diameter and the surface to finish a regenerated cylinder 2, and forming a photosensitive film 3 on the peripheral surface of said regenerated cylinder 2.

For convenience's sake, at first, the bulging apparatus used for executing the methods of the present invention will be briefly described.

Figure 2:
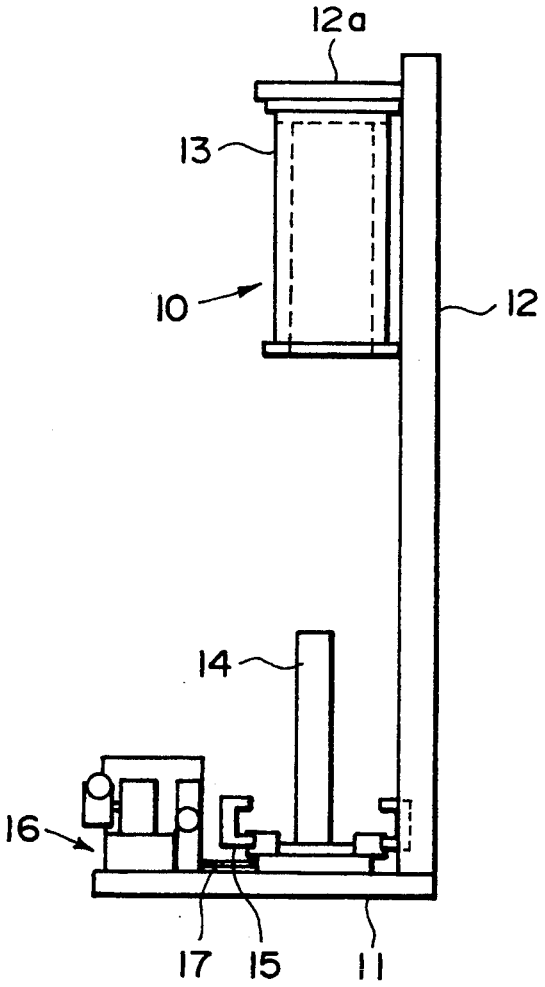
FIG. 2 is an explanatory view of a bulging apparatus used for executing the present invention.

As shown in FIG. 2, the bulging apparatus 10 consists of a base 11, a metal mold support member 12 stood on said base, an elevator stage **12*a* attached to said metal mold support member so as to be lifted up/down, a cylindrical metal mold 13 supported by said stage, a hollow gum mold 14 provided right under the metal mold 13 on the base 11, clamps 15 for uniting the electrophotography photosensitive drum (not shown) and the gum mold 14 inserted therein in the metal mold 13 when the metal mold is lowered, and a pressurized fluid generator 16 for supplying pressurized fluid into the gum mold 14**.

An embodiment of the method of the present application for preparing the regenerated cylinder and the regenerated electrophotography photosensitive drum will be described.

FIGS. 3A to 3D are explanatory views showing the diameter enlargement processes by bulging the photosensitive drum to be regenerated.

As shown in FIG. 3A, before executing bulging, the metal mold 13 has been attached to the elevator stage **12*a* shown in FIG. 2 and moved upward along the metal mold support member 12 so as to be positioned aloof from the gum mold 14. At that time, the clamps 15** are loosened (unclamped).

Then, as shown in FIG. 3B, the photosensitive drum 1X to be regenerated is set on the gum mold 14, and the metal mold 13 is lowered as indicated to position a flange portion 13a thereof so that the flange portion gets in touch with a gum mold support member **14*a***.

After that, as shown in FIG. 3C, the clamps 15 are fastened to clamp the flange portion **13*a* and the gum mold support member 14*a*, thus the metal mold 13 and the gum mold 14** are united.

Subsequently, as shown in FIG. 3D, the gum mold is swelled by supplying pressurized fluid into the gum mold 14 in order to execute diameter enlargement, wherein the photosensitive drum 1X to be regenerated is expanded into the shape of the cavity surface of the metal mold 13.

At this time, since the metal mold 13 and the gum mold 14 are united by the clamps as described above, the metal mold 13 and the gum mold 14 do not separate from each other, thereby executing diameter enlargement with high precision.

The outer diameter of the photosensitive drum enlarged by the above-mentioned bulging is determined by the inner diameter of the metal mold 13. The enlarged portion obtained by said diameter enlargement is to be the machining allowance in the next step of cutting off the peripheral surface. The amount of enlargement is determined according to the depth of a flaw and mechanical precision with respect to the cylinder of the photosensitive drum 1X to be regenerated. But, the amount must be within a range where the cylinder of the photosensitive drum after diameter enlargement can function normally.

Next, the gum mold 14 is contracted by stopping supply of pressurized fluid, the clamps 15 are loosened, then, the metal mold 13 is shifted upward to be located at the fetching position, and the photosensitive drum whose diameter was enlarged is taken out. At this time, as the photosensitive drum having the enlarged diameter is contracted a little due to spring back and there occurs clearance between the drum and the inner surface of the metal mold 13, the photosensitive drum can be easily taken out.

Next, the surface, including the photosensitive film, of the photosensitive drum having the enlarged diameter is cut off and finished with predetermined precision of the outer diameter and the surface to obtain the regenerated cylinder.

After that, the surface of said regenerated cylinder is coated with an amorphous silicon photosensitive film having predetermined thickness (for example, 20–30 μm) by vacuum evaporation to obtain the regenerated electrophotography photosensitive drum. Note that, needless to say, other kinds of photosensitive films such as that of an OPC (organic photoconductor), and the like can be employed as the coating.

An embodiment of the method of the present application for preparing the regenerated cylinder and the regenerated electrophotography photosensitive drum will be described.

In this embodiment, the step of diameter enlargement by bulging and the step of cutting off the surface of the photosensitive drum to be regenerated exchange their places in the procedure in said first embodiment.

That is, prior to the diameter enlargement, the surface, including the photosensitive film, of the photosensitive drum 1X to be regenerated is cut off to obtain the cylinder with predetermined precision of the outer diameter and the surface. Then, said cylinder is subjected to the diameter enlargement as in the above first embodiment to prepare the regenerated cylinder. However, the inner diameter of the cavity surface of the metal mold used in this embodiment is different from that of the metal mold used in the first embodiment. The inner diameter of the metal mold used here is: (the outer diameter of the regenerated electrophotography photosensitive drum)—2X (film thickness of the photosensitive film thereof).

Now, an embodiment of the bulging apparatus used for executing the above method will be described.

Figure 4:
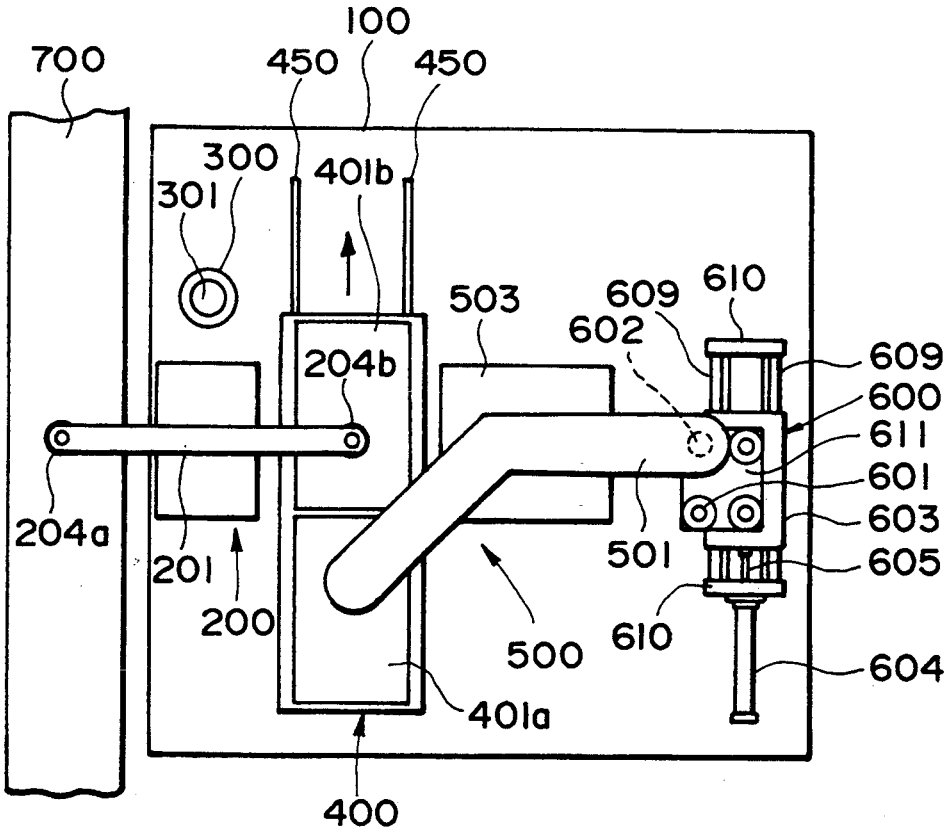
FIG. 4 is a schematic plan view of an embodiment of the bulging apparatus used for executing the method of the present invention.
Figure 5:
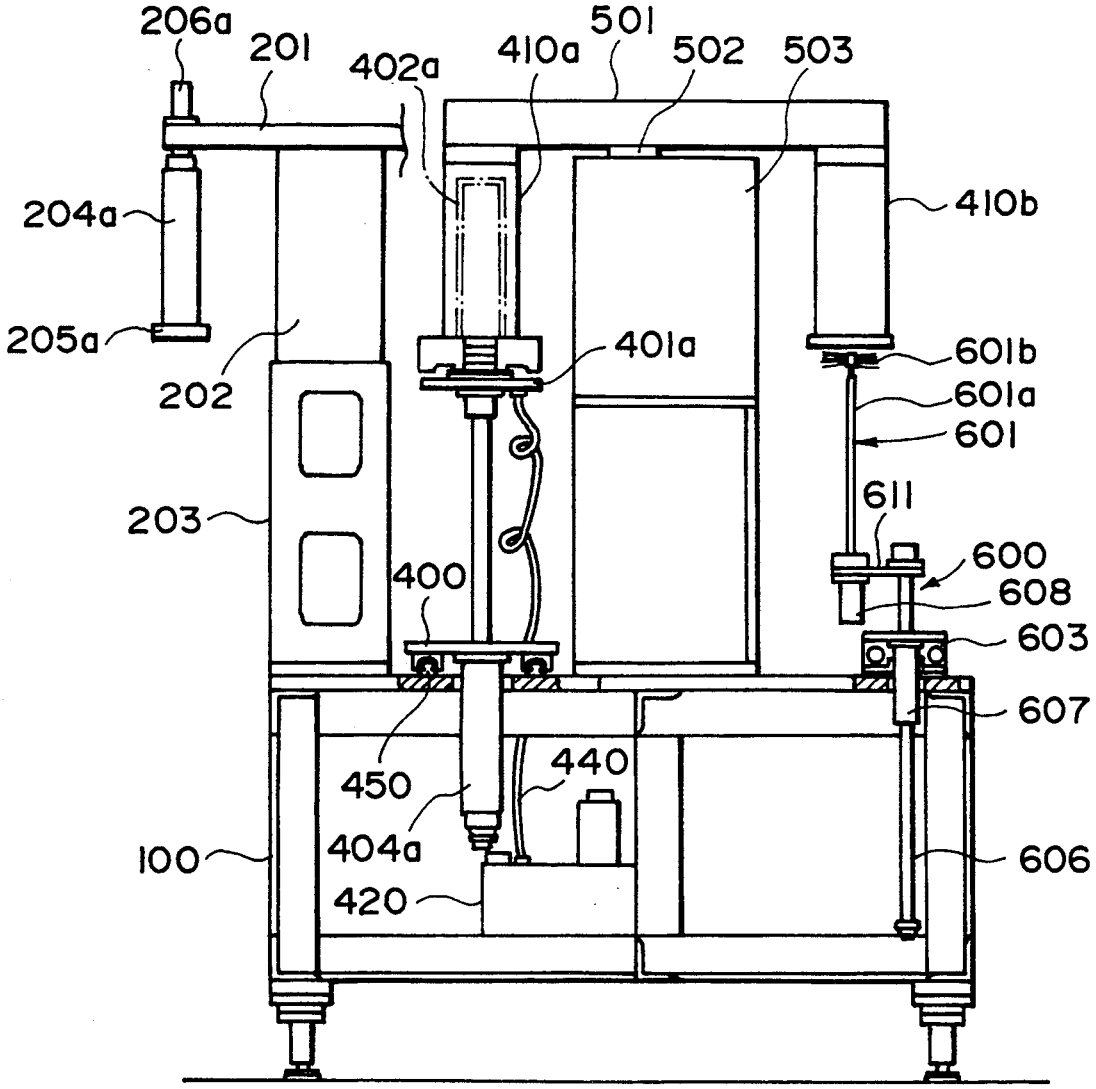
FIG. 5 is a partially sectional plan view showing the bulge apparatus shown in FIG. 4.
Figure 6:
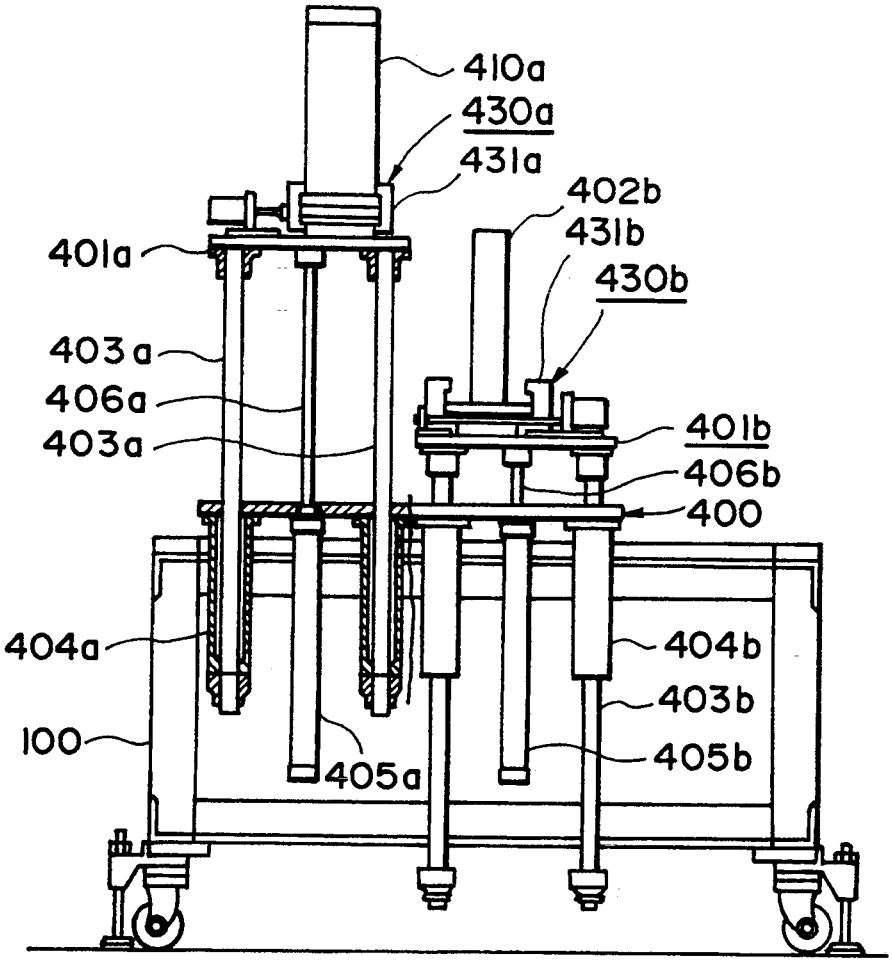
FIG. 6 is a partially sectional side view showing only main portions of the bulging apparatus shown in FIG. 4.

FIG. 4 is a plan view of the first embodiment of the bulging apparatus, FIG. 5 is a partially sectional schematic plan view of the bulging apparatus of this embodiment, and FIG. 6 is a partially sectional side view showing only main portions of the bulging apparatus of this embodiment.

As shown in FIG. 4, in the bulging apparatus of this embodiment, an auto-hand unit 200, a gum mold shift unit 400, a metal mold revolving unit 500 and a metal mold cleaning unit 600 are arranged, from the side of a conveyer 700 in the order named, substantially in a line at predetermined intervals, on the upper surface of a table like base 100, wherein a work oil sprayer unit 300 is further provided right under the revolutionary orbit of a pair of clampers 205*a*, 206*b* (not shown) of a revolvable arm 201 (described later) of the auto-hand unit 200.

Auto-Hand Unit

The auto-hand unit 200 is provided with: a pivot 202 revolvably supported by a guide 203 stood on the base 100; and a revolvable arm 201 attached to the upper end of the pivot, wherein a first clamper unit 204*a* and a second clamper unit 204*b* are arranged at the ends of the revolvable arm 201 respectively.

The first clamper unit 204*a* has a first clamper 205*a* lifted up/down by a first clamper cylinder 206*a*. Any kinds of clampers which can be inserted into the photosensitive drum to be regenerated and can hold the drum from the inside may be employed as the first clamper 205*a*.

The second clamper unit 204*b* is similar to the first clamper unit 204*a*, and description thereof is omitted.

Work Piece Oil Sprayer Unit

The work piece oil sprayer unit 300 serving as a work piece oil applicator unit is located so that either the first clamper 205*a* or the second clamper 205*b* is positioned right above the work piece oil sprayer unit when the revolvable arm 201 is rotated clockwise by 90° from the position shown in FIG. 4. Any kinds of work piece oil sprayer units which have a nozzle 301 lifted up/down by an elevator (not shown) and which can spray lubricating oil from said nozzle 301 may be employed.

Gum Mold Shift Unit

The gum mold shift unit 400 is located between the auto-hand unit 200 and the metal mold revolving unit 500 on the base 100, and is guided by a pair of guide rails serving as guide means which are arranged in parallel, wherein the gum mold shift unit is capable of reciprocation in the direction indicated by an arrow in FIG. 4. The gum mold shift unit 400 supports a first gum mold support unit 401*a* and a second gum mold support unit 401*b*; a pair of gum mold support units aligned in the direction of reciprocation, and positions them alternately at the delivery stage and the diameter enlargement stage.

First Gum Mold Support Unit and Second Gum Mold Support Unit

Since the first gum mold support unit 401*a* and the second gum mold support unit 401*b* have the same construction, only the second gum mold support unit 401*b* will be described.

As shown in FIG. 6, on the upper surface of the second gum mold support unit 401*b*, there are supported a second gum mold 402 and a second clamp unit 430*b* having a pair of viselike stoppers 431*b* for preventing the molds from separating from each other. And on the lower surface of the second gum mold support unit 401*b*, there are provided: a plurality of rods 403*b* projecting downwards, which can be slidden through a plurality of guides 404*b* fixed to the gum mold shift unit 400. Also, on said lower surface, there is further fixed an end of a second piston rod 406*b* of a second cylinder 405*b* which is fixed to the gun mold shift unit 400.

Metal Mold Revolving Unit

The metal mold revolving unit 500 consists of a pivot 502 revolvably supported by a support member 503 stood on the base 100, and a revolvable hand 501 which has V-like shape in plan and is fixed on the upper end of the pivot 502, wherein a first metal mold 410*a* and a second metal mold 410*b* are provided in the respective ends of the revolvable hand 501; at the same radial distance from said pivot. The first metal mold 410*a* and the second metal mold 410*b* can be alternately positioned above the diameter enlargement stage and above the metal mold cleaning unit 600 by revolving the revolvable hand 501 by a predetermined angle.

Metal Mold Cleaning Unit

The metal mold cleaning unit 600 is provided with a slide stage which can be horizontally slidden while guided by a pair of guide rods 609 provided between a pair of support plates 610 stood at a predetermined interval on the base, and an elevator stage 611 to be lifted up/down supported by upper ends of a plurality of rods 606 which are able to slide through a plurality of guides 607 provided on the slide stage 603, wherein the elevator stage 611 is lifted up/down by driving force of a cylinder (not shown) and the slide stage 603 is slidden by driving force of a cylinder 604. The elevator stage is provided with a cleaning brush unit 601 and a metal mold oil sprayer unit 602 with an interval therebetween along the direction in which the slide stage 603 slides. The cleaning brush unit 601 and the metal mold oil sprayer unit 602 are respectively positioned with respect to the metal mold by sliding the slide stage 603.

The cleaning brush unit 601 has a brush **601*b* at the upper end of a pivot 601*a* which is revolvably supported by a bearing of the elevator stage 611, wherein the brush is rotated by a brush motor 608 directly joined with said pivot 601*a***.

Now, operations of the present embodiment will be described.

(1) At first, the first clamper **205*a* of the first clamper unit 204*a* is initialized so as to be positioned above the conveyer 700 (see FIG. 4), while the work piece is initialized so as to be positioned on the conveyer 700 and right under the first clamper 205*a* of the first clamper unit 204*a***. Positioning of the work piece is executed, for example, by stopping the conveyer according to the position of the work piece detected by a sensor (not shown).

At this time, the second clamper **205*b* is positioned above the second gum mold support unit 401*b* shown in FIG. 4**.

(2) Next, the first clamper cylinder **206*a* operates to lower the first clamper 205*a*, which is inserted into the work piece on the conveyer 700 and is stopped at a predetermined position. At this time, the first clamper 205*a* is loosened. Subsequently, the first clamper 205*a* clamps said work piece so as to support the inner surface thereof, and the first clamper cylinder 206*a* operates in the opposite direction to elevate the first clamper 205*a*** supporting the work piece to a predetermined position.

At the same time, the second clamper **205*b* of the second clamper unit 204*b*** which supports the work piece whose diameter has been enlarged is elevated by the operation described later.

(3) After that, the revolvable arm 201 shown in FIG. 4 rotates clockwise by 90° to position the work piece supported by the first clamper **205*a* with respect to the work piece oil sprayer unit 300, where the work piece stays for ca. 3.5 min. During this time, the nozzle 301 of the work piece oil sprayer unit 300 is elevated and inserted into the vicinity of the upper end of the work piece, where said nozzle 301 starts to spray lubricating oil. Then, while spraying lubricating oil, the nozzle 301 of the work piece oil sprayer unit 300** is lowered to coat the entire inner surface of the work piece uniformly with lubricating oil. The nozzle stops spraying when it is lowered to the vicinity of the lower end of the work piece, then is further lowered to the lowest position of its movement.

At this time, the second clamper **205*b* supporting the work piece whose diameter and enlarged is located at the upper side between the conveyer 700 and the gum mold shift unit 400**.

During the above operations, the gum mold shift unit 400 is shifted as indicated by the arrow in FIG. 4 so as to position the first gum mold support unit **301*a* at the position of the second gum mold support unit 401*b* in FIG. 4**; that is, at the delivery stage.

(4) Subsequently, the revolvable arm 201 is further rotated by 90° to position the first clamper unit **204*a* right above a first gum mold 402*a* of the waiting first gum mold support unit 401*a* (see FIG. 5**).

At this time, the second clamper **205*b* supporting the work piece having the enlarged diameter is located above the conveyer 700**.

(5) After that, the first clamper cylinder **206*a* is operated downward so that the first clamper 205*a* supporting the work piece is lowered till the first gum mold 402*a* is inserted to said work piece. When said first gum mold 402*a* is inserted to a predetermined position of said work piece, the first clamper 205*a* is loosened so as to deliver said work piece to the first gum mold 402*a*. Then, the first cylinder 206*a* is operated upward so as to elevate the first clamper 205*a*** to a predetermined position.

During this time, the second gum mold 402 executes diameter enlargement of the work piece as described later, while the second clamper **205*b* supporting the work piece having the enlarged diameter is also lowered, and then elevated to a predetermined position after unclamping the work piece having the enlarged diameter onto the conveyer 700**.

(6) Subsequently, the gum mold shift unit 400 is shifted in the opposite direction as indicated by the arrow by a driving means (not shown) such as a cylinder and the like in order to position the first and second gum mold support units **401*a* and 401*b* as illustrated by the solid line in FIG. 4, which are then positioned right under the first clamper unit 204*a*** positioned by the operation as described in the latter half of the above-mentioned step (5).

(7) After that, the first gum mold support unit **401*a* is elevated by the operation of the first cylinder 405*a* so as to insert the work piece in which the first gum mold 402*a* has been inserted into the first metal mold 410*a***.

(8) Then, the first clamp unit **430*a* operates to unite the flange portion of the first metal mold 410*a* and the gum mold support member of the first gum mold 402*a*, wherein they are held between a pair of the viselike stoppers 431*b*** for preventing the molds from separating from each other.

(9) After that, pressurized fluid generated by the pressurized fluid generator 420 is introduced through a pipe 440 into the first gum mold **402*a* to inflate the first gum mold 402*a***. The pressure P of pressurized fluid is represented as:

$$P \geqq h \times \sigma \div r + pg$$

wherein: h is a thickness of the cylinder of the photosensitive drum to be regenerated before diameter enlargement; $\sigma$ is flow stress of said cylinder, which is greater than proof stress of the material employed and equal to or less than rupture strength; r is an inner radius of said cylinder before diameter enlargement; and pg is flow stress of the gum.

The enlarged amount B can be determined in the range where: B is larger than the range of elastic deformation of the material of the cylinder, and is smaller than the maximum limit of expansion of said material (that is, ca. 0.1 to 25%, expressed by percentage).

Incidentally, diameter enlargement was executed where $h=5$ mm, $\sigma=20$ kg/mm$^2$, $r=52$ mm, $pg=1$ kg/mm$^2$ and $P=3$ kg/mm$^2$.

During this time, the second metal mold **410*b* of the revolvable hand 501 is positioned above the metal mold cleaning unit 600**, where the cavity surface thereof is cleaned and sprayed with oil.

The auto-hand unit, the work piece oil sprayer unit and the metal mold cleaning unit of the above-mentioned embodiment are not always necessary, but may be provided if desirable.

Next, a variation of the above-mentioned embodiment of the bulging apparatus will be described.

Figure 7:
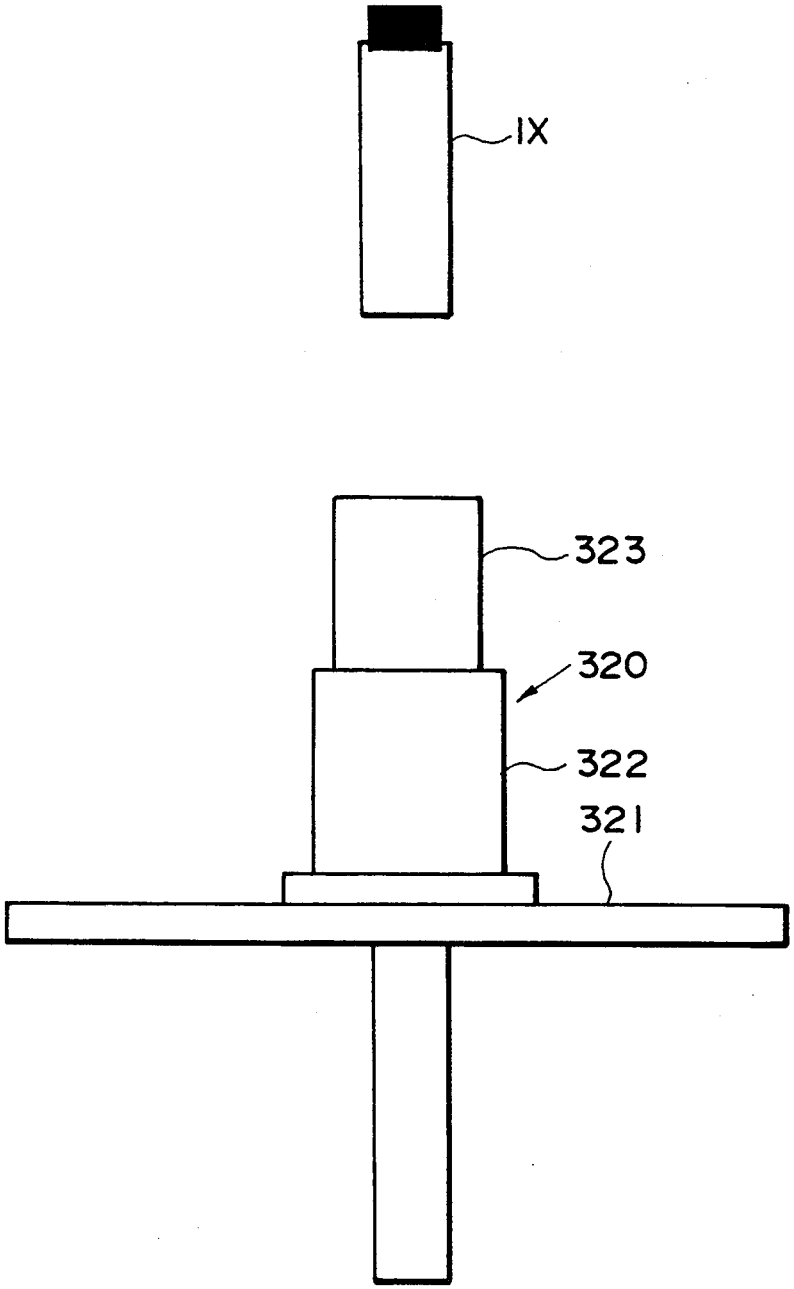
FIG. 7 is a schematic side view of a work piece oil applicator, which is a modification of the bulging apparatus used for executing the method of the present invention.

This variation is provided with an oil applicator shown in FIG. 7 in place of the work piece oil sprayer unit 300 shown in FIG. 2.

As shown in FIG. 7, an oil applicator 320 consists of an elevator 321, an oil receiver 322 provided thereon, and an oil container put in the oil receiver.

Now, the operations of this variation will be described. In the above-mentioned step (2), the elevator 321 is elevated toward the photosensitive drum to be regenerated held by the clampers in order to elevate the oil container 323 put in the oil receiver 322 up to the position where the entire photosensitive drum to be regenerated is immersed in lubricating oil, thereby coating the inner and the outer surfaces of the photosensitive drum to be regenerated with lubricating oil. Then, the elevator is lowered and the oil container returns to its original position.

The other parts and operations of this variation are the same as those of the first embodiment, and description thereof is omitted.

As the present invention has the above-mentioned construction, the following effects are to be obtained.

The photosensitive drum to be regenerated, whose photosensitive film does not function normally because of being used up or damaged during preparation or the like, can be regenerated except small portion to be cut off, a great contribution to resource saving can be made and, at the same time, the cost of regeneration can be considerably reduced.

Further, the bulging apparatus according to FIG. 5 is capable of executing diameter enlargement of the photosensitive drum to be regenerated with high accuracy, and of realizing excellent productivity.

Next, an embodiment for realizing a regenerated electrophotography photosensitive drum employing a regenerated cylinder will be described with reference to FIGS. 8 to 11, wherein peripheral components previously assembled in the photosensitive drum to be regenerated are assembled in the electrophotography photosensitive drum regenerated by employing the regenerated cylinder whose diameter was enlarged by the above-mentioned regeneration processes.

Figure 8:
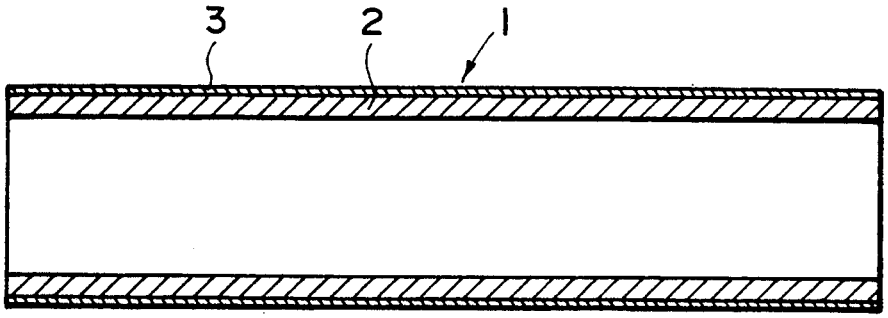
FIG. 8 is a schematic cross-sectional view of the regenerated electrophotography photosensitive drum employing the regenerated cylinder whose diameter has been enlarged by the regeneration processes.

FIG. 8 is a schematic cross-sectional view of a regenerated electrophotography photosensitive drum used in the present embodiment.

The regenerated electrophotography photosensitive drum 1 shown 8 is regenerated from the drum (hereinafter referred as "photosensitive drum to be regenerated") whose photosensitive film does not function normally because of being used up or damaged during preparation or the like.

As described above, the outer diameter and the surface of the cylinder of the electrophotography photosensitive drum must be highly precise to realize the necessary function of the photosensitive film.

Therefore, the regenerated electrophotography photosensitive drum 1 according to the present invention is obtained by enlarging the diameter of the photosensitive drum to be regenerated to predetermined size by the above-mentioned bulging and cutting off the surface thereof including the photosensitive film with predetermined precision of the outer diameter and the surface. Or, the surface including the photosensitive film is first cut off with predetermined precision of the outer diameter and the surface, and then diameter enlargement to predetermined size is executed by bulging to obtain the regenerated cylinder 2. And a new photosensitive film 3 which functions normally is formed on the surface of the cylinder 2.

Accordingly, the regenerated electrophotography photosensitive drum 1 shown in FIG. 8 has a larger inner diameter than the photosensitive drum to be regenerated before diameter enlargement, and has been constructed in the axial direction.

According to the present invention, the electrophotography photosensitive drum unit is constructed by employing the regenerated electrophotography photosensitive drum 1 prepared as described above, and preferable embodiments will be described below.

Figure 9:
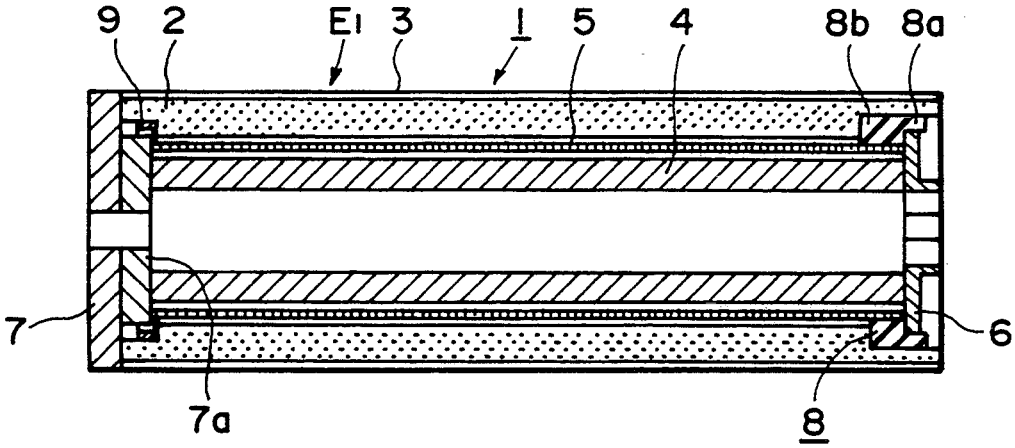
FIG. 9 is a schematic cross-sectional view of a regenerated electrophotography photosensitive drum unit employing the regenerated cylinder whose diameter has been enlarged by the regeneration processes.

The first embodiment shown in FIG. 9 will be described.

A regenerated electrophotography photosensitive drum unit E1 of this embodiment comprises a regenerated electrophotography photosensitive drum 1 in which a cylindrical heater 5 and a cylindrical drum reinforcing member 4 are concentrically inserted. A flange 6 having a bearing and a flange 7 having gear are fixed at respective ends of the heater and the drum reinforcing member with assembling bolts, nuts, and the like (not shown) so that the opposing surfaces of the flanges are in contact with respective ends. In this case, a spacer 8 having a shape to adjust the enlarged inner diameter and the contracted axial length of the regenerated electrophotography photosensitive drum 1 is placed between the flange 6 having the bearing and a flange attachment position at one end of said regenerated electrophotography photosensitive drum 1.

That is, the spacer 8 has a ringed shape consisting of a thin radial spacer portion **8*a* having a thickness corresponding to said enlarged amount of the inner diameter .and a thick axial spacer portion 8*b* having an axial length corresponding to said contracted amount; these portions are integrally formed. Therefore, by placing the spacer 8, the heater 5, the drum reinforcing member 4 and the flange 6** having the bearing which were previously assembled to the photosensitive drum to be regenerated can be used without machining.

Further, a second spacer 9 is placed between the flange attachment position, to which the flange 7 having gear is assembled, at the other end of the regenerated electrophotography photosensitive drum 1 and a small diameter portion, which is a projection of the flange 7 having gear. The second spacer 9 is not necessary, but when placed, it facilitates positioning of the drum and the flange.

The present embodiment can easily carry out positioning when the spacers are placed.

Next, the second embodiment of the electrophotography photosensitive drum unit employing the regenerated electrophotography photosensitive drum will be described with reference to FIG. 10. The same portions as those in the above-mentioned first embodiment are indicated by the same referential numerals and symbols, and description thereof is omitted.

Figure 10:
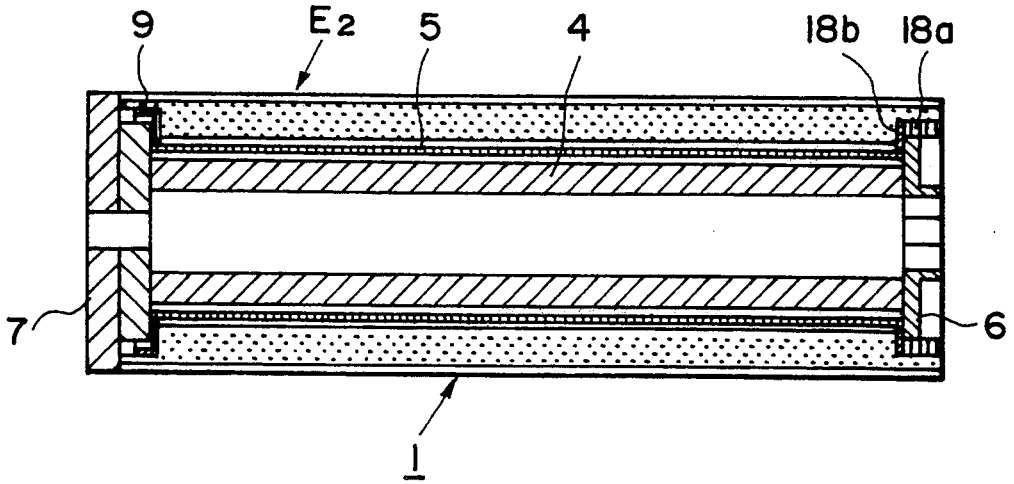
FIG. 10 is a schematic sectional view of another regenerated electrophotography photosensitive drum unit employing the regenerated cylinder whose diameter has been enlarge, regeneration processes.

As shown in FIG. 10, the heater 5 and the drum reinforcing member 4 are inserted into the regenerated electrophotography photosensitive drum 1, and the flange 7 having gear and the flange 6 having the bearing are assembled to the flange attachment portions of both ends of the drum.

In this case, as the length of the regenerated electrophotography photosensitive drum 1 is contracted during diameter enlargement, an axial spacer **18*b* for adjusting the contracted length is placed between the flange 6 having the bearing and the flange attachment position at one end of the regenerated electrophotography photosensitive drum 1**. Said spacer is made of a metal material (phosphor bronze) or resin such as nylon.

Further, a ringed radial spacer **18*a* is placed between the peripheral surface of the flange 6 having the bearing and the flange attachment position of the regenerated electrophotography photosensitive drum 1 in order to compensate the enlarged amount of the inner diameter of the regenerated electrophotography photosensitive drum 1**.

Figure 11:
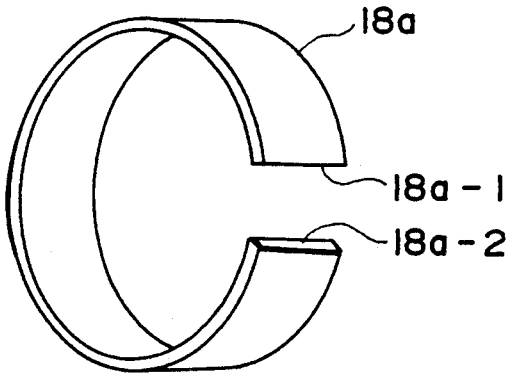
FIG. 11 is perspective view of a radial spacer of the embodiment shown in FIG. 10.

The radial spacer **18*a* has a partially-cut-ringed shape as shown in FIG. 11, whose outer diameter is a little greater than the inner diameter of the flange attachment position of the regenerated electrophotography photosensitive drum 1. Accordingly, the outer diameter of the radial spacer 18*a* is reduced when it is put in the flange attachment position of the regenerated electrophotography photosensitive drum 1**, wherein the spacer elastically recovers its original outer diameter and contacts itself to the inner surface of the flange attachment position. As a result, the spacer can be fit with precision.

As the present invention is constructed as described above, the following effects can be obtained.

Interchangeability is realized when the photosensitive drum to be regenerated is replaced by the regenerated electrophotography photosensitive drum employing the regenerated cylinder having the diameter enlarged by regeneration processes. As a result, a great contribution to resource saving can be made.

Furthermore, since the spacers can be produced by press working or injection molding of synthetic resin, the cost can be lowered. At the same time, since the peripheral components, including flanges, which were previously assembled in the photosensitive drum to be regenerated can be assembled in said regenerated electrophotography photosensitive drum without machining, that is, the peripheral components can be used again, the manufacturing cost of the regenerated electrophotography photosensitive drum unit is considerably reduced.

Next, an embodiment of the regenerated electrophotography photosensitive drum having a photosensitive film formed on the peripheral surface of the regenerated cylinder whose diameter was enlarged by regeneration processes will be described, wherein at least one end portion of said regenerated electrophotography photosensitive drum is subjected to additional machining to newly form an attachment position having shape and size of other kinds of electrophotography photosensitive drums.

As described before, the outer diameter and the surface of the cylinder of the electrophotography photosensitive drum must be highly precise to realize the necessary function of the photosensitive film. Therefore, the diameter of the photosensitive drum as the target of regeneration is enlarged to predetermined size by bulging, and then the surface thereof coated with the photosensitive film is cut off. Or, the surface of the photosensitive drum to be regenerated which is coated with the photosensitive film is first cut off, and then diameter enlargement to predetermined size is executed by bulging to obtain the regenerated cylinder 2 with desired precision with respect to the outer diameter and the surface. And the photosensitive film 3 which functions normally is formed on the surface of the cylinder 2.

Accordingly, as the regenerated cylinder 2 has a larger inner diameter than the cylinder of the photosensitive drum to be regenerated and has been contracted in the axial direction, the peripheral components previously assembled in the photosensitive drum to be regenerated cannot be assembled in the electrophotography photosensitive drum 1 employing the regenerated cylinder 2 without machining.

Figure 12:
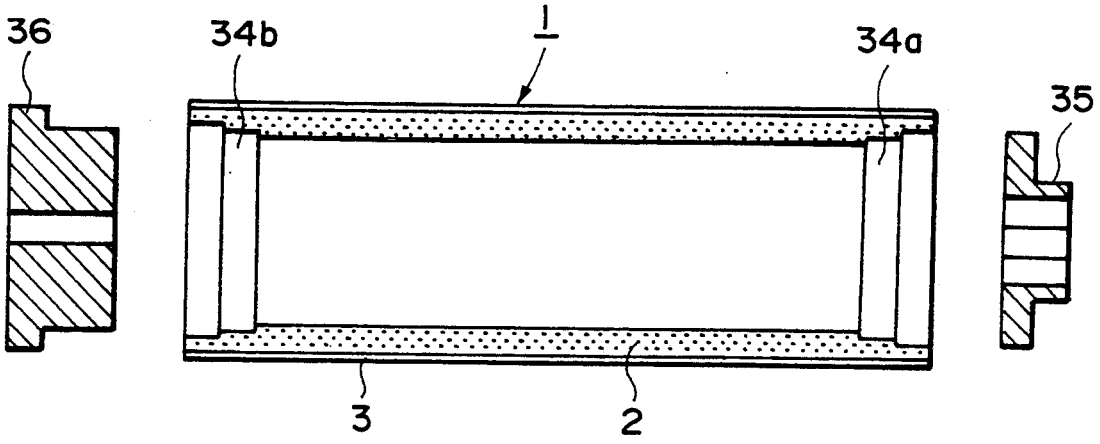
FIG. 12 is an explanatory view of another embodiment.
Figure 13:
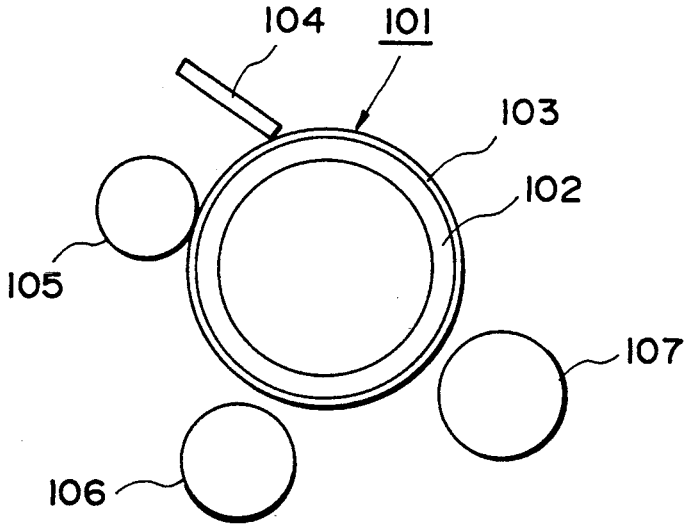
FIG. 13 is an explanatory view of an image forming apparatus according to a conventional electrophotography method.

For this reason, the end portions of the regenerated electrophotography photosensitive drum 1 are subjected to additional machining such as cutting and the like to form new attachment positions having shape and size of other kinds of drums. Thus, a flange 35 having a bearing and a flange 36 having gear, which are the peripheral components of another kind, are attached to said attachment positions (FIG. 12).

A photosensitive drum whose outer diameter was 107 mm and whose axial length was 350 mm was used, wherein the cylinder was a drawing member of an aluminum alloy and the surface of the drum finished with predetermined precision with respect to the outer diameter and the surface was coated with an amorphous silicon photosensitive film having a film thickness of 20–30 μm by vacuum evaporation.

Diameter enlargement was executed by bulging so that the outer diameter of said photosensitive drum to be regenerated might be 107.4 mm. At that time, the axial length became 349.76 mm.

The peripheral surface of said photosensitive drum having the enlarged diameter was cut off by 0.4 mm; substantially equal to the enlarged amount, to obtain predetermined precision with respect to the surface. On said surface, an amorphous silicon photosensitive film which functioned normally was formed to obtain a regenerated electrophotography photosensitive drum having an outer diameter of 107 mm. Then, the flange attachment positions on the inner surface at both ends of the drum were subjected to additional machining to have shape and size to which another kind of flanges could be attached.

The present invention is not limited to the above-mentioned embodiments, but can be applied to photosensitive drums to be regenerated having other kinds of photosensitive film such as the OPC. Also, the outer diameter of the regenerated electrophotography photosensitive drum can be arbitrarily determined as long as diameter enlargement can be carried out.

As the present invention is constructed as described above, the following effects can be obtained.

The regenerated electrophotography photosensitive drum employing the regenerated cylinder having the diameter enlarged during regeneration processes can be applied to other kinds of devices having attachment positions of different shape and size by executing simple additional machining, thereby making a great contribution to resource saving. Further, as only the simple additional machining is required, machining cost is reduced, which is economical.

What is claimed is:

1. A method of regenerating a photosensitive drum coated with photosensitive film on a surface thereof for use in an electrophotography type image formation apparatus, said method comprising the steps of:

enlarging a diameter of the photosensitive drum by means of a bulging process, thereby obtaining the drum to be regenerated, after preparing the photosensitive drum having photosensitive film which has not functioned normally;

cutting off the drum surface including the photosensitive film, thereby working the drum to an outer diameter at which the drum is capable of being assembled into the image formation apparatus; and coating a photosensitive film on the surface of the drum.

2. A method according to claim 1, wherein said step of enlarging the diameter by means of the bulging process comprises the steps of:

preparing a first mold having an inner diameter corresponding to a diameter of the drum to be enlarged, and a gum mold, to be arranged in the drum, for applying a pressure for enlarging the diameter of the drum; and applying oil to an inside surface of the first mold in order to effect smoothly the enlargement of the diameter of the drum.

3. A method according to claim 1, further comprising the step of:

providing, at an end of the drum whose diameter has been enlarged, an adjustment member for adjusting a position of a driving member for driving the photosensitive drum in the image formation apparatus, the driving member comprising a flange having a gear.

4. A method according to claim 1, further comprising the step of:

providing, at an end of the drum whose diameter has been enlarged, an adjustment member for adjusting a position of a driving member for driving the photosensitive drum in the image formation apparatus, the driving member comprising a flange having a bearing.

5. A method of regenerating a photosensitive drum coated with photosensitive film on a surface thereof for use in an electrophotography type image formation apparatus, said method comprising the steps of:

cutting off the drum surface including the photosensitive film to finish the drum surface to a predetermined precision, after preparing the photosensitive drum having photosensitive film which has not functioned normally;

enlarging a diameter of the drum by means of a bulging process, thereby obtaining the drum to be regenerated; and coating a photosensitive film on the surface of the drum.

6. A method according to claim 5, wherein said step of enlarging the diameter by means of the bulging process comprises the steps of:

preparing a first mold having an inner diameter corresponding to a diameter of the drum to be enlarged, and a gum mold for applying a pressure for enlarging the diameter of the drum; and applying oil to an inside surface of the first mold in order to effect smoothly the enlargement of the diameter of the drum.

7. A method according to claim 5, further comprising the step of:

providing, at an end of the drum whose diameter has been enlarged, an adjustment member for adjusting a position of a driving member for driving the photosensitive drum in the image formation apparatus, the driving member comprising a flange having a gear.

8. A method according to claim 5, further comprising the step of:

providing, at an end of the drum whose diameter has been enlarged, an adjustment member for adjusting a position of a driving member for driving the photosensitive drum in the image formation apparatus, the driving member comprising a flange having a bearing.

* * * * *

UNITED STATES PATENT AND TRADEMARK OFFICE

CERTIFICATE OF CORRECTION

PATENT NO. : 5,400,630

DATED : March 28, 1995

INVENTOR(S) : Toru OKUMURA, et al.

It is certified that error appears in the above-indentified patent and that said Letters Patent is hereby corrected as shown below:

TITLE PAGE

At [56] References Cited - U.S. PATENT DOCUMENTS

"647,334 4/1990 Shuman" should read
--647,334 4/1900 Shuman--.

At [56] References Cited - FOREIGN PATENT DOCUMENTS

"2178671 7/1990 Japan ." should read
--2-178671 7/1990 Japan .--.

COLUMN 2:

Line 20, "larging" should read --larging of--.

COLUMN 3:

Line 53, "enlarge," should read --enlarged by the--.

COLUMN 4:

Line 13, "stood" should read --standing--.

COLUMN 5:

Line 67, "stood" should read --standing--.

UNITED STATES PATENT AND TRADEMARK OFFICE

CERTIFICATE OF CORRECTION

PATENT NO. : 5,400,630

DATED : March 28, 1995

INVENTOR(S) : Toru OKUMURA, et al.

It is certified that error appears in the above-indentified patent and that said Letters Patent is hereby corrected as shown below:

COLUMN 6:

Line 52, "slidden" should read --slid--;
Line 61, "stood" should read --standing--.

COLUMN 7:

Line 6, "slidden" should read --slid--;
Line 8, "stood" should read --standing--;
Line 14, "slidden" should read --slid--.

COLUMN 9:

Line 67, "shown 8" should read --shown in FIG. 8--.

COLUMN 10:

Line 54, ".and" should read --and--.

Signed and Sealed this

Fifteenth Day of August, 1995

Bruce Lehman

*Attest:*

BRUCE LEHMAN

*Attesting Officer*

*Commissioner of Patents and Trademarks*